US009890553B2

(12) United States Patent
Esses et al.

(10) Patent No.: US 9,890,553 B2
(45) Date of Patent: Feb. 13, 2018

(54) PROTECTIVE ENCLOSURE FOR, AND METHOD OF, PROTECTING A PATIENT ON A STRETCHER

(71) Applicant: A & V Equities LLC, Brooklyn, NY (US)

(72) Inventors: Abraham J. Esses, Brooklyn, NY (US); Victor Sutton, Brooklyn, NY (US)

(73) Assignee: A & V Equities LLC, Brooklyn, NY (US)

( * ) Notice: Subject to any disclaimer, the term of this patent is extended or adjusted under 35 U.S.C. 154(b) by 67 days.

(21) Appl. No.: 14/951,568

(22) Filed: Nov. 25, 2015

(65) Prior Publication Data

US 2017/0145711 A1 May 25, 2017

(51) Int. Cl.

| | |
|---|---|
| ***A47G 5/00*** | (2006.01) |
| ***E04H 15/02*** | (2006.01) |
| ***A61G 1/04*** | (2006.01) |
| ***E04H 15/32*** | (2006.01) |
| ***E04H 15/00*** | (2006.01) |
| *A61G 1/013* | (2006.01) |
| *A61G 10/02* | (2006.01) |
| *A61G 10/00* | (2006.01) |

(52) U.S. Cl.

CPC ..... *E04H 15/02* (2013.01); *A61G 1/04* (2013.01); *E04H 15/008* (2013.01); *E04H 15/324* (2013.01); *A61G 1/013* (2013.01); *A61G 10/005* (2013.01); *A61G 10/02* (2013.01)

(58) Field of Classification Search

CPC ..... E04H 15/02; E04H 15/008; E04H 15/324; A61G 1/04; A61G 1/013; A61G 10/005; A61G 10/02; A61G 7/0526; A61G 7/0513; A47C 21/00; A47C 21/024; A47C 29/003; B62B 9/14; B62B 9/142

See application file for complete search history.

(56) References Cited

U.S. PATENT DOCUMENTS

| | | | | | |
|---|---|---|---|---|---|
| 1,577,089 | A | * | 3/1926 | Whitford | A47C 21/024 5/505.1 |
| 1,702,010 | A | * | 2/1929 | Klever | A61G 7/0507 296/20 |
| 2,209,801 | A | * | 7/1940 | Valverde | A61G 7/0501 219/217 |
| 2,524,469 | A | * | 10/1950 | Orford | A47C 21/024 5/505.1 |
| 2,579,964 | A | * | 12/1951 | Reynolds | A47C 21/048 126/204 |

(Continued)

*Primary Examiner* — David E Sosnowski
*Assistant Examiner* — Morgan McClure
(74) *Attorney, Agent, or Firm* — Kirschstein, Israel, Schiffmiller & Pieroni, P.C.

(57) ABSTRACT

A protective enclosure provides patient privacy and protection from inclement weather to a patient on a mattress on a stretcher. The enclosure includes a pair of slidable base portions and a cover connected to, and extending between, the base portions. The base portions are movable toward and away from each other in a transverse common plane underneath the mattress along a transverse axis that extends widthwise of the mattress. The cover bounds an interior space in which a body part of the patient is received. The cover has an overhead structure that extends along the transverse axis above the transverse common plane.

5 Claims, 6 Drawing Sheets

(56) References Cited

U.S. PATENT DOCUMENTS 2,598,295 A * 5/1952 Pelton ..... A47C 21/024 5/505.1
2,607,933 A * 8/1952 Fulton ..... A47C 21/024 248/214
2,642,589 A * 6/1953 Cobb ..... A47C 21/024 5/505.1
2,674,750 A * 4/1954 Moore ..... A47C 21/024 5/505.1
3,050,747 A * 8/1962 Uhl ..... A47C 21/024 5/505.1
3,121,881 A * 2/1964 Schnell ..... A61G 1/013 5/113
3,408,667 A * 11/1968 Rajakaruna ..... A47C 21/024 5/482
3,763,507 A * 10/1973 Propst ..... A47D 7/00 5/100
4,027,818 A * 6/1977 Stoll ..... B65D 5/06 229/158
4,287,622 A * 9/1981 Lane ..... A47C 21/024 5/505.1
4,937,903 A * 7/1990 Joly ..... A47C 21/044 5/284
4,939,803 A * 7/1990 Waters ..... A47C 7/66 5/113
D311,713 S * 10/1990 McAfee ..... 5/626
4,975,997 A * 12/1990 Misiura ..... A61G 7/0501 5/505.1
5,303,434 A * 4/1994 Arnold ..... A47D 7/00 135/138
5,438,720 A * 8/1995 Daneshvar ..... A47C 20/021 5/424
5,511,259 A * 4/1996 Tarara ..... A47C 7/66 135/133
6,076,206 A * 6/2000 Celaya ..... A61G 1/04 135/119
6,487,735 B1 * 12/2002 Jacques, II ..... A47D 7/02 5/424
7,789,292 B2 * 9/2010 West ..... B65D 5/0263 229/109
8,272,086 B1 * 9/2012 Calmes ..... A47C 21/024 5/505.1

* cited by examiner

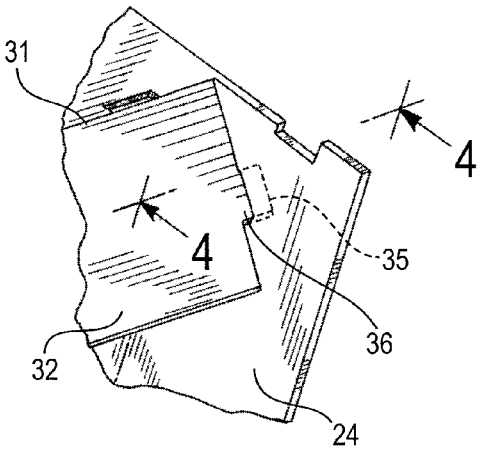
FIG. 3
FIG. 4
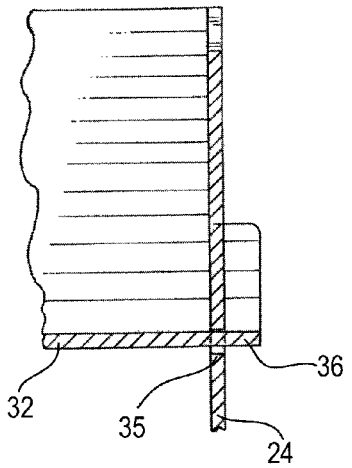
FIG. 5
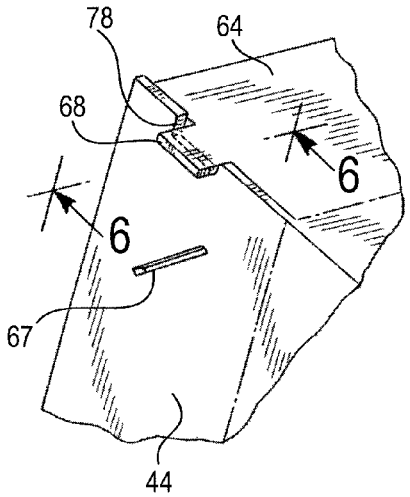
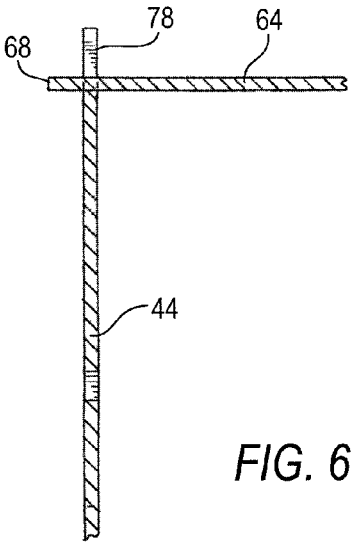
FIG. 6

PROTECTIVE ENCLOSURE FOR, AND METHOD OF, PROTECTING A PATIENT ON A STRETCHER

BACKGROUND OF THE INVENTION

The present disclosure generally relates to a protective enclosure for, and a method of, protecting a patient on a stretcher, and, more particularly, to safeguarding the patient's privacy, as well as to shielding the patient from inclement weather.

Stretchers are frequently used by ambulance and hospital personnel and in routine and emergency situations to transport an injured or ill individual. The individual is placed on a stretcher and wheeled or carried from the scene of an accident or other location to an ambulance, and from the ambulance into an emergency room of a hospital. If the emergency room is busy, the individual may remain on the stretcher for a long period of time until medical care arrives, and sometimes, especially if an empty bed is not readily available, medical care may be administered to the individual while being supported on the stretcher in the emergency room. Even after being admitted to the hospital, the individual may be moved from place to place on the stretcher for medical treatment.

As satisfactory as such stretchers have been in transporting individuals, patient privacy concerns arise for such individuals on stretchers. Many individuals do not wish to be stared at by strangers, and often may feel embarrassed when moved on a stretcher in public. Many individuals value their privacy and do not wish to have their faces and identities exposed in ambulances, emergency rooms and hospitals. In addition, such individuals are sometimes exposed to inclement weather, e.g., rain, snow or hail, while being transported in a supine or sitting position and are not protected from the elements.

Accordingly, it would be desirable to provide patient privacy and protection from inclement weather to such individuals on stretchers.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

FIG. 3 is a broken-away, perspective view of a front corner region of the protective enclosure of FIG. 1.

FIG. 4 is a sectional view taken on line 4-4 of FIG. 3.

FIG. 5 is a broken-away, perspective view of a rear corner region of the protective enclosure of FIG. 1.

FIG. 6 is a sectional view taken on line 6-6 of FIG. 5.

Figure 1:
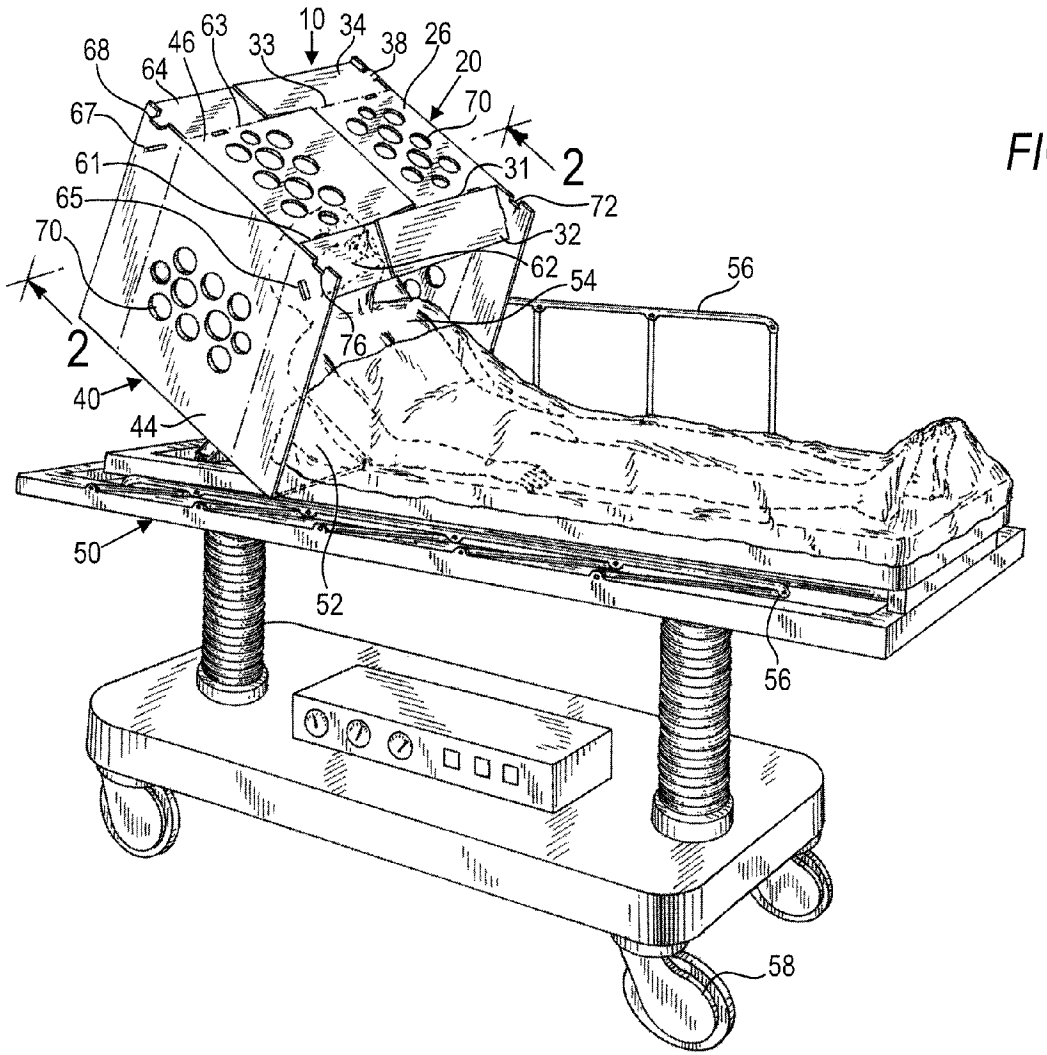
FIG. 1 is a perspective view of a protective enclosure for protecting a patient on a mattress on a stretcher in accordance with this disclosure.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present invention.

The structural and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

In accordance with one feature of this disclosure, a protective enclosure protects a patient supported on a mattress on a stretcher. The protective enclosure includes a pair of slidable base portions and a cover connected to, and extending between, the base portions. The base portions are movable toward and away from each other in a transverse common plane underneath the mattress along a transverse axis that extends widthwise of the mattress. The cover bounds an interior space in which a body part, e.g., principally, the head, and preferably also, the upper torso, of the patient, is received. The cover has an overhead structure that extends along the transverse axis above the transverse common plane. The cover acts as a screen and provides patient privacy and protection from inclement weather.

More particularly, the protective enclosure comprises a first enclosure part having a first, generally planar, slidable base panel; a first, generally planar, upright panel hinged to the first base panel; and a first, generally planar, overhead panel hinged to the first upright panel. The protective enclosure also comprises a second enclosure part having a second, generally planar, slidable base panel; a second, generally planar, upright panel hinged to the second base panel; and a second, generally planar, overhead panel hinged to the second upright panel. The first and second base panels are movable toward and away from each other in a transverse common plane underneath the mattress along a transverse axis that extends widthwise of the mattress. The first and second overhead panels extend along the transverse axis above the transverse common plane. The first and second upright panels and the first and second overhead panels together constitute a cover that bounds an interior space in which the aforementioned body part of the patient is received. The cover acts as a screen and provides patient privacy and protection from inclement weather.

In accordance with another feature of this disclosure, a method of protecting a patient supported on a mattress on a stretcher, is performed by forming a first enclosure part with a first, generally planar, slidable base panel; a first, generally planar, upright panel hinged to the first base panel; and a first, generally planar, overhead panel hinged to the first upright panel; and, also, by forming a second enclosure part with a second, generally planar, slidable base panel; a second, generally planar, upright panel hinged to the second base panel; and a second, generally planar, overhead panel hinged to the second upright panel. The method is further performed by inserting the first and second base panels underneath the mattress, by moving the first and second base panels toward and away from each other in a transverse common plane underneath the mattress along a transverse axis that extends widthwise of the mattress, by moving the first and second upright panels jointly with the first and second base panels along the transverse axis to an adjustment position in which the first and second upright panels straddle, and contact, opposite lateral sides of the mattress, and by interconnecting the first and second overhead panels to extend along the transverse axis above the transverse common plane to form a cover that bounds an interior space in which the aforementioned body part of the patient is received.

Figure 2:
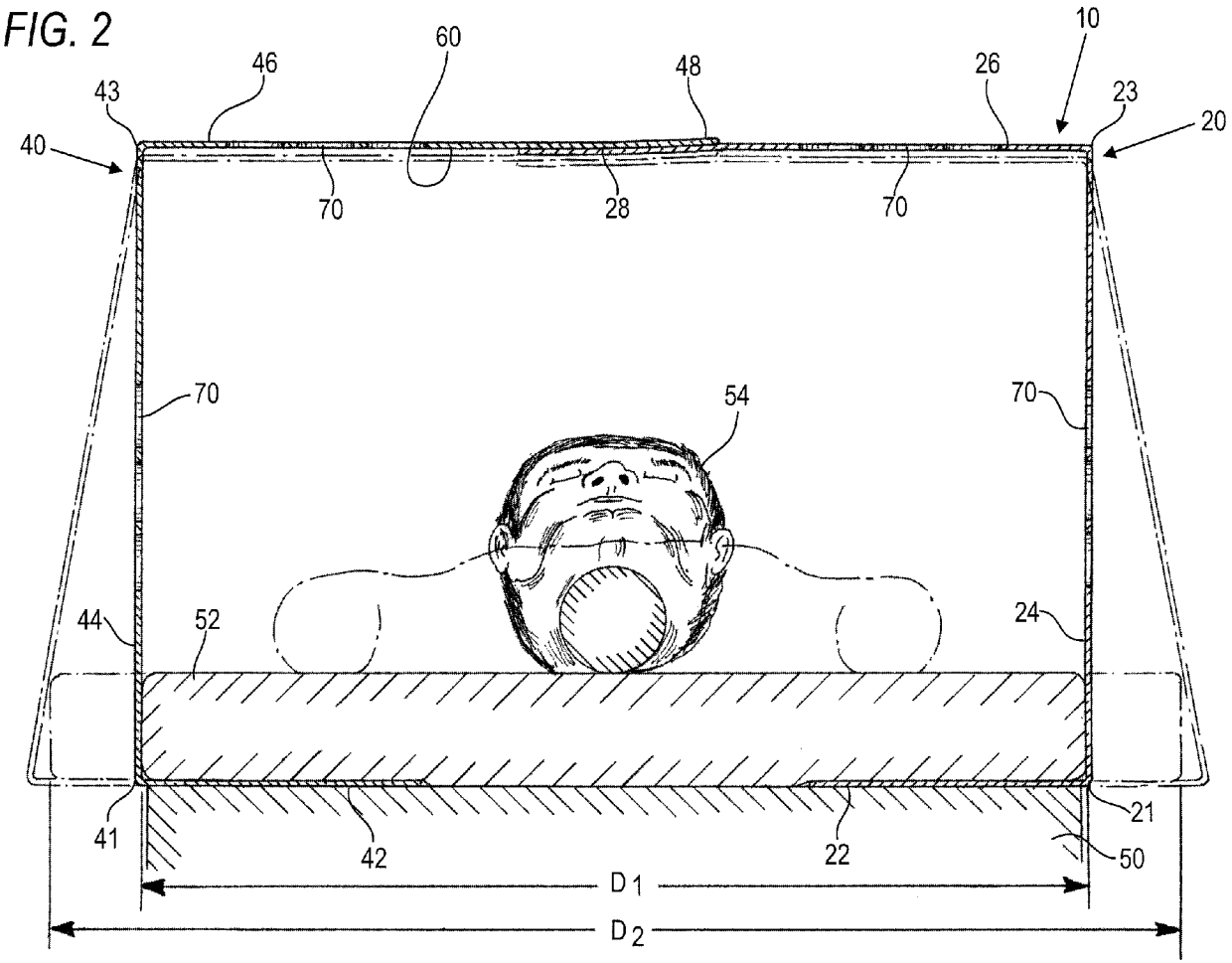
FIG. 2 is an enlarged sectional view taken on line 2-2 of FIG. 1, and depicting in phantom lines how the protective enclosure is adjusted to accommodate mattresses of different widths.

Referring now to the drawings, reference numeral 10 in FIGS. 1 and 2 identifies a protective enclosure for attachment to a bed or stretcher 50 having a pad or mattress 52 on which a patient 54 is supported, typically in a supine position. The stretcher 50 can be any apparatus for moving the patient 54 requiring medical care. As shown, the stretcher 50 is a conventional wheeled stretcher, also known as a gurney, bed, trolley, or cart, and has a set of wheels 58, a pair of side rails 56 that can be raised or lowered, a multi-section frame, and a control mechanism for raising or lowering the frame in elevation, or for tilting at least one of the frame sections. The stretcher 50 could also not have any wheels. The mattress 52 is typically a foam pad for patient comfort and warmth.

Figure 9:
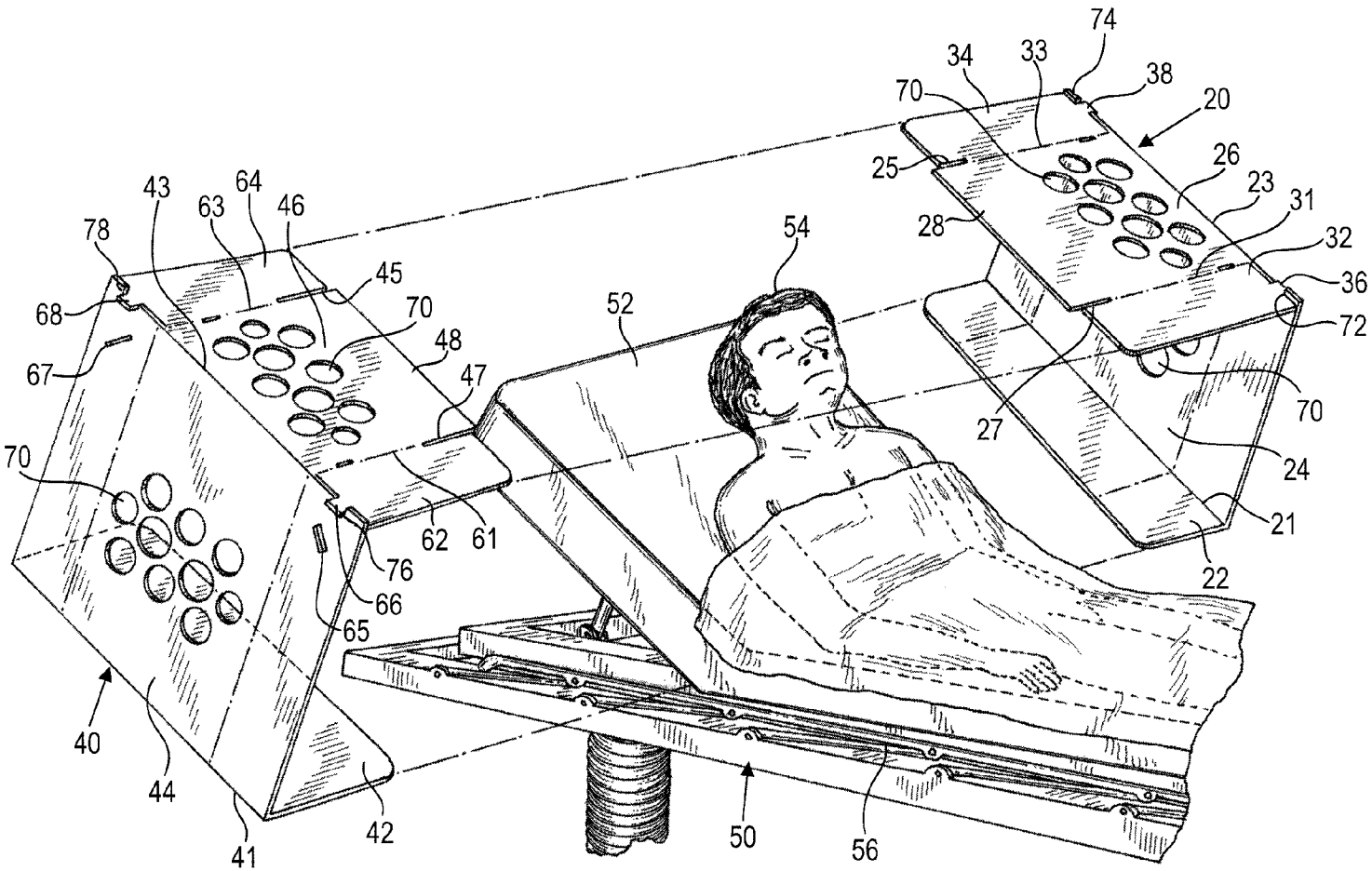
FIG. 9 is a broken-away, perspective view of the protective enclosure of FIG. 1, depicting its attachment to the stretcher.

As best shown in FIG. 9, the enclosure 10 includes a first enclosure part 20 having a first, generally planar, slidable base portion or base panel 22; a first, generally planar, upright portion or upright panel 24 that is hinged to the first base panel 22 along a linear crease, fold line, or hinge 21; and a first, generally planar, overhead portion or overhead panel 26 hinged to the first upright panel 24 along a linear crease, fold line, or hinge 23. The panels 22, 24, and 26 are preferably of a one-piece, integral construction. The enclosure 10 also includes a second enclosure part 40 having a second, generally planar, slidable base portion or base panel 42; a second, generally planar, upright portion or upright panel 44 that is hinged to the second base panel 42 along a linear crease, fold line, or hinge 41; and a second, generally planar, overhead portion or overhead panel 46 hinged to the second upright panel 44 along a linear crease, fold line, or hinge 43. The panels 42, 44, and 46 are likewise preferably of a one-piece, integral construction. Each enclosure part 20, 40 is constituted of an opaque, light-blocking material, such as corrugated board, cardboard, heavy-duty paper, plastic, and the like, and preferably of an inexpensive, recyclable material that can be discarded after each patient use. The material of each enclosure part 20, 40 may be laminated for increased strength and ease of cleaning.

The enclosure 10 is attached to stretcher 50 as follows: First, the first and second base panels 22, 42 are inserted underneath the mattress 52 and are movable, as shown in phantom lines in FIG. 2, toward and away from each other in a transverse common plane underneath the mattress 52 along a transverse axis that extends widthwise of the mattress 52. The first and second upright panels 24, 44 are jointly moved with the first and second base panels 22, 42 along the transverse axis to an adjustment position in which the first and second upright panels 24, 44 straddle, and contact, opposite lateral sides of the mattress 52. As depicted by the reference dimensions D1 and D2 in FIG. 2, the mattress 52 can come in various widths, e.g., from about twenty-six inches through about thirty-two inches. The joint movement of the first and second base panels 22, 42 and the first and second upright panels 24, 44 accommodates the enclosure 10 to the width of any particular mattress 52.

Figure 8:
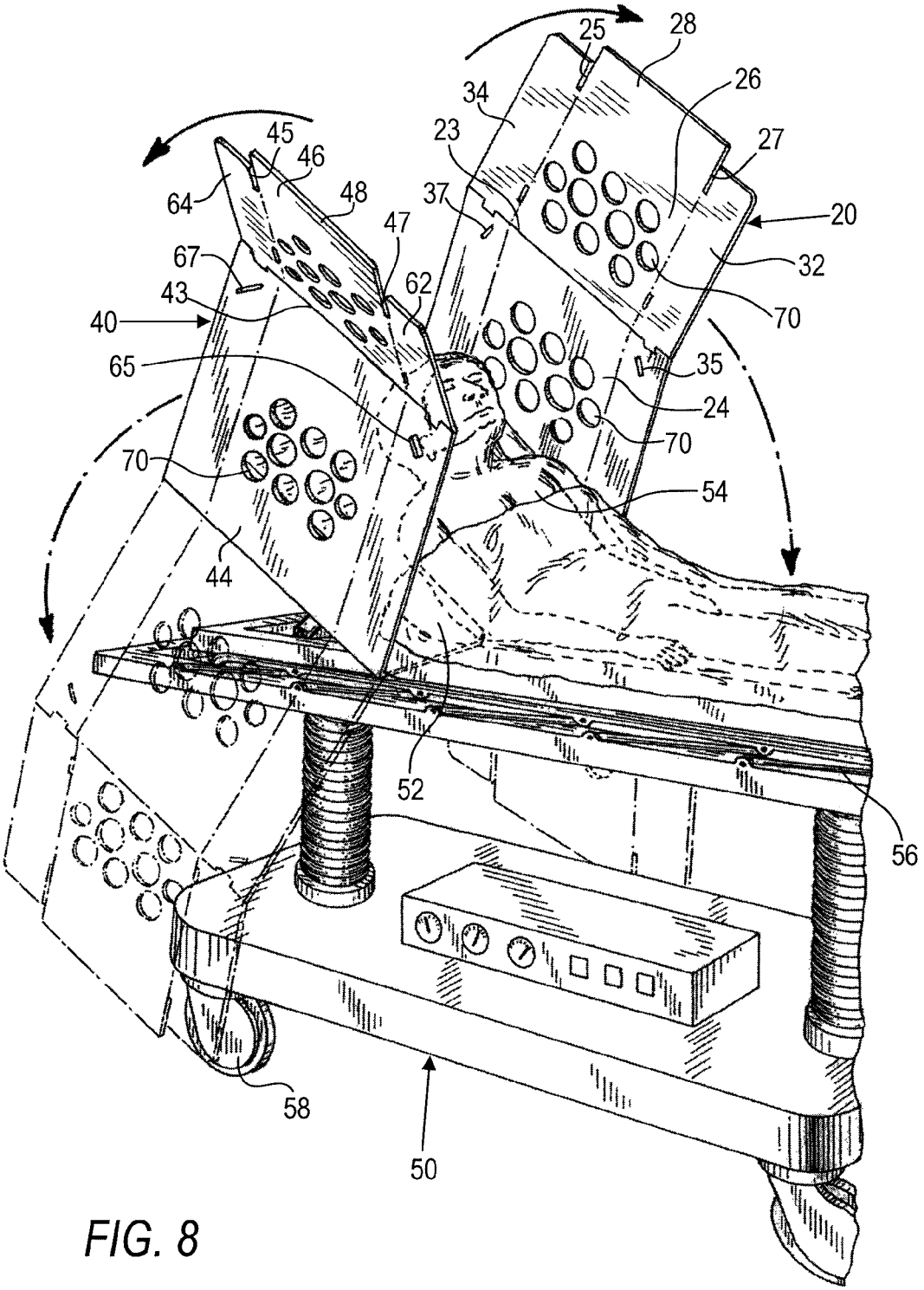
FIG. 8 is a broken-away, perspective view of the protective enclosure of FIG. 1, after the two parts of the protective enclosure are separated.

Then, the first and second overhead panels 26, 46 are interconnected so that they extend along the transverse axis above the transverse common plane to form a cover that bounds an interior space 60 (see FIG. 2) in which a body part, e.g., principally, the head, and preferably, also, the upper torso, of the patient 54, is received. As best seen in FIG. 9, the overhead panel 26 has a pair of slits 25, 27 bounding a central projecting flap 28, and the overhead panel 46 has a pair of slits 45, 47 bounding a central projecting flap 48. The slits 25, 27 enable the central flap 28 to move or bend slightly up or down. The slits 45, 47 enable the central flap 48 to move or bend slightly up or down. As best seen in FIG. 2, one of the central flaps, e.g., 48, is bent up and passed over, and slid along the transverse axis across, the other central flap 28. The central flap 28 is bent down and lies underneath the central flap 48 and is in surface area contact therewith. The central flaps 28, 48 are thus interleaved and frictionally engage each other with a sufficient locking force to prevent their inadvertent detachment. As shown in FIG. 8, the interleaved central flaps 28, 48 can be detached and separated from each other by affirmatively pulling the central flaps 28, 48 apart.

As best seen in FIG. 1, the attached protective enclosure 10 acts as a box-like screen or generally parallelepiped-shaped cover that provides patient privacy since the patient's face and identity are concealed, since, as noted above, the enclosure parts are constituted of an opaque, light-blocking material. The protective enclosure 10 is anchored and held in position by the first and second base panels 22, 42, which are captured between the mattress 52 and the frame of the stretcher 50. To enable the patient to look out at his/her surroundings for increased comfort, a plurality of openings 70 is formed in the protective enclosure 10. Although the openings 70 are shown as circular holes arranged in a clustered pattern and provided in each of the upright and overhead panels, it will be understood that these are merely exemplary, because, shapes, other than circles, can be utilized, and that the openings can be arranged in any desired pattern, and that the openings need not be provided in each upright and overhead panel, but could be formed in any one or more panels.

In a preferred embodiment, the first and second overhead panels 26, 46 include front overhead flaps 32, 62 that are respectively foldable about linear creases, fold lines, or hinges 31, 61 toward the mattress 52, and rear overhead flaps 34, 64 that are respectively foldable about linear creases, fold lines, or hinges 33, 63 toward the mattress 52. The front and rear overhead flaps 32, 34 are cut to form end projections 36, 38, and the front and rear overhead flaps 62, 64 are cut to form end projections 66, 68. The first and second upright panels 24, 44 respectively have front inclined slots 35, 65 and rear inclined slots 37, 67.

As best seen in FIG. 1, the front overhead flaps 32, 62 are folded downwardly about hinges 31, 61 toward the mattress 52 until the end projections 36, 66 are received in the front inclined slots 35, 65. An enlarged view of this interconnection is depicted in FIGS. 3-4 for the representative flap 32, end projection 36, and inclined slot 35. The folded-down front overhead flaps 32, 62 serve not only as a reinforcement to add structural integrity to the enclosure 10, hut also act as a visor to further screen the patient's face and identity from direct view from the front of the enclosure and provide an additional measure of privacy protection.

Although the rear overhead flaps 34, 64 could be folded downwardly about hinges 33, 63 toward the mattress 52 until the end projections 38, 68 are received in the rear inclined slots 37, 67, it is preferred not to do so. Instead, the first upright panel 24 has front and rear notches 72, 74, which were formed when the end projections 36, 38 were cut; and the second upright panel 44 has front and rear notches 76, 78, which were formed when the end projections 66, 68 were cut. As best seen in FIG. 1, the end projections 38, 68 of the rear overhead flaps 34, 64 are received with a friction fit in the rear notches 74, 78 to add structural integrity to the enclosure 10. An enlarged view of this interconnection is depicted in FIGS. 5-6 for the representative flap 64, end projection 68, and rear notch 78. Although the end projections 36, 66 of the front overhead flaps 32, 62 could be received with a friction fit in the front notches 72, 76, it is preferred not to do so.

Figure 7:
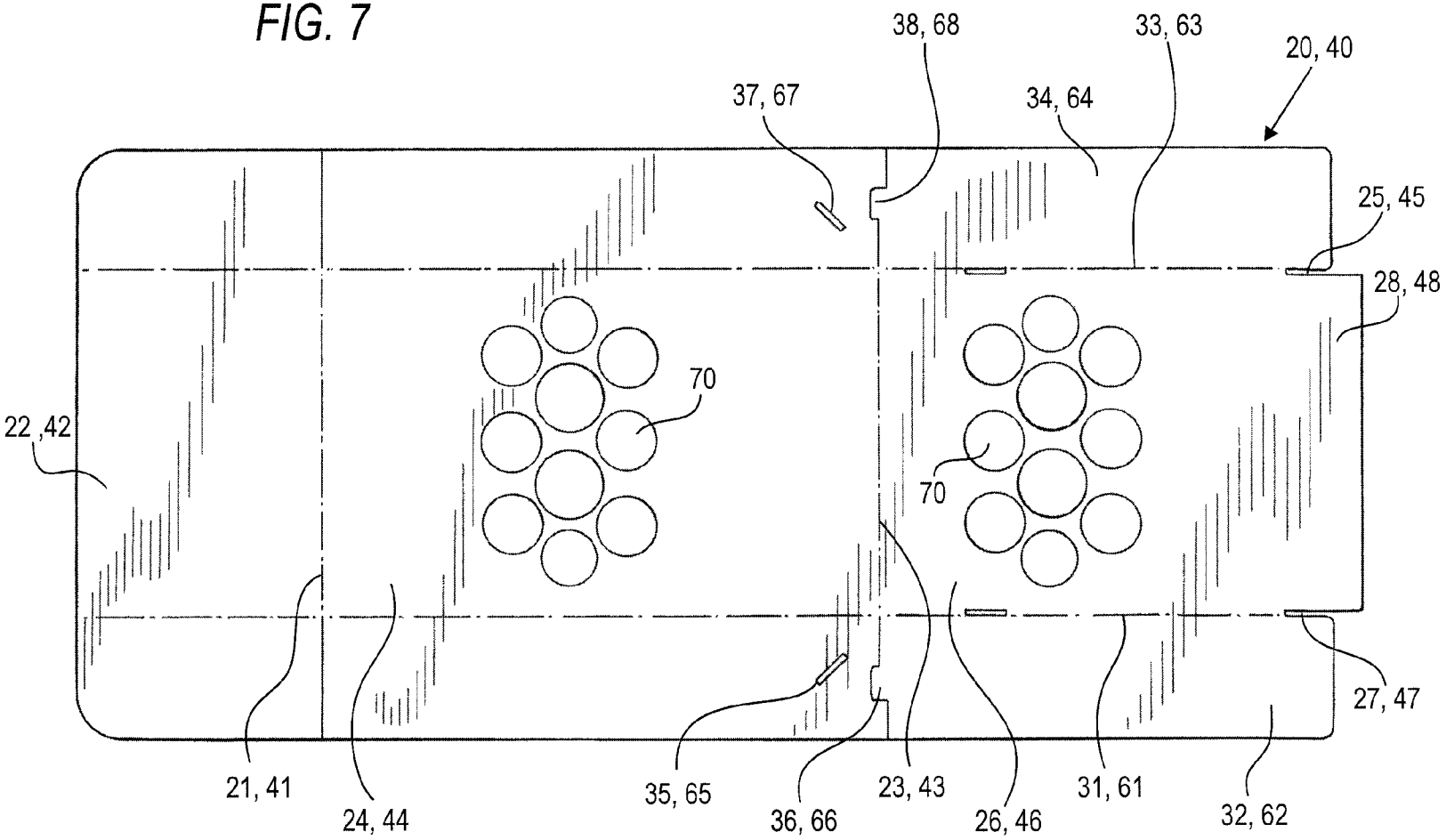
FIG. 7 is a top plan view of each of the two parts of the protective enclosure in blank form prior to being folded to form the protective enclosure of FIG. 1.

FIG. 7 depicts each of the first and second enclosure parts 20, 40 in a flat blank form prior to being folded. Each of the enclosure parts 20, 40 are identical to simplify manufacture, shipping, and inventory control.

In the foregoing specification, specific embodiments have been described. However, one of ordinary skill in the art appreciates that various modifications and changes can be made without departing from the scope of the invention as set forth in the claims below. For example, rather than forming the protective enclosure of two parts, it is also contemplated to form the protective enclosure of one piece. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or arrangement that comprises, has, includes, contains a list of elements does not include only those elements, but may include other elements not expressly listed or inherent to such process, method, article, or arrangement. An element proceeded by "comprises . . . a," "has . . . a," "includes . . . a," or "contains . . . a," does not, without more constraints, preclude the existence of additional identical elements in the process, method, article, or arrangement that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A protective enclosure for providing privacy and protection to a patient supported on a mattress on a stretcher, comprising:

a first enclosure part having a first, planar, slidable base panel, a first, planar, upright panel hinged to the first base panel, and a first, planar, overhead panel hinged to the first upright panel;

a second enclosure part having a second, planar, slidable base panel, a second, planar, upright panel hinged to the second base panel, and a second, planar, overhead panel hinged to the second upright panel;

the first and second enclosure parts being identical;

the first and second base panels being movable toward and away from each other in a transverse common plane underneath the mattress along a transverse axis that extends widthwise of the mattress, each of the first and second base panels being flat and lying entirely in the transverse common plane;

the first and second overhead panels extending along the transverse axis above the transverse common plane;

each overhead panel having a pair of slits bounding a central flap;

the first and second overhead panels being detachably interconnected with the central flap of the first overhead panel being interleaved with the central flap of the second overhead panel;

the first and second upright panels having front upright flaps; and the first and second upright panels and the first and second overhead panels together constituting a cover that bounds an interior space in which a head of the patient is received, and the cover being constituted of an opaque material for at least partly shielding the head from view to afford privacy to the patient, the first and second overhead panels having front overhead flaps that engage the front upright flaps to further shield the head of the patient.

2. The enclosure of claim 1, wherein the first and second base panels and their hinged first and second upright panels are jointly movable along the transverse axis to an adjustment position in which the first and second upright panels straddle, and contact, opposite lateral sides of the mattress.

3. The enclosure of claim 1, and further comprising a plurality of openings in the first and second upright panels.

4. The enclosure of claim 1, wherein the first and second upright panels have front inclined slots in the front upright flaps, and wherein the front overhead flaps have opposite end projections that are received in the front inclined slots in an inclined position of the front overhead flaps.

5. The enclosure of claim 1, wherein the first and second upright panels have rear notches, wherein the first and second overhead panels include rear overhead flaps having opposite end projections that are received in the rear notches.

* * * * *